US006755920B2

(12) United States Patent
Kamada et al.

(10) Patent No.: US 6,755,920 B2
(45) Date of Patent: Jun. 29, 2004

(54) LOW-ALLOY HEAT-RESISTANT STEEL, HEAT TREATMENT METHOD THEREFOR, AND TURBINE ROTOR COMPRISING THE SAME

(75) Inventors: Masatomo Kamada, Nagasaki (JP); Akitsugu Fujita, Nagasaki (JP); Yoshiyuki Ooba, Yokohama (JP); Yoshihiro Okamura, Kitakyusyu (JP); Makoto Yamaguchi, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 113 days.

(21) Appl. No.: 10/086,699

(22) Filed: Mar. 4, 2002

(65) Prior Publication Data

US 2003/0034101 A1 Feb. 20, 2003

(30) Foreign Application Priority Data

Mar. 6, 2001 (JP) ..... 2001-061842

(51) Int. Cl.[7] ..... C22C 38/40; C22C 38/46; C21D 9/00

(52) U.S. Cl. ..... 148/335; 148/660; 420/109; 416/241 R

(58) Field of Search ..... 148/660, 335; 420/109, 107; 416/241 R

(56) References Cited

U.S. PATENT DOCUMENTS

| | | |
|---|---|---|
| 3,954,454 A | 5/1976 | Shaw |
| 5,108,699 A | 4/1992 | Bodnar et al. |
| 5,611,873 A | 3/1997 | Yamada et al. |

FOREIGN PATENT DOCUMENTS

| | | | |
|---|---|---|---|
| EP | 1 091 010 | 4/2001 | |
| JP | 60-70125 | 4/1985 | |
| JP | 362278251 | * 12/1987 | ..... C22C/38/54 |

OTHER PUBLICATIONS

Patent Abstracts of Japan, JP 10–081935, Mar. 31, 1998.
Patent Abstracts of Japan, JP 2–019425, Jan. 23, 1990.

(List continued on next page.)

*Primary Examiner*—Deborah Yee
(74) *Attorney, Agent, or Firm*—Oblon, Spivak, McClelland, Maier & Neustadt, P.C.

(57) ABSTRACT

A low-alloy heat-resistant steel may be used to manufacturing a large element which has uniform superior high temperature properties through a surface layer to a center part. The low-alloy heat-resistant steel comprises carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, antimony in an amount not greater than 0.003% by weight, and the balance being iron and unavoidable impurities, and containing a metallic structure having an austenitic grain size number in a range of from 3 to 6.

26 Claims, 1 Drawing Sheet

OTHER PUBLICATIONS

K. Kimura, et al., Scripta Metallurgica, vol. 21, No. 1, pp. 19–22, XP–001080766, "Effect of Prior Austenite Grain Size on High Temperature Creep Properties of Cr–Mo–V Rotor Steel", Jan. 1987.

N. S. Cheruvu, et al., Metallurgical Transactions A, vol. 20A, No. 11, pp. 2345–2354, XP–001084567, "The Influences of Impurity Content, Tensile Strength, and Grain Size on In–Service Temper Embrittlement of CrMoV Steels", Nov. 1989.

M. Yamada, et al., Clean Steel: Super Clean Steel, pp. 109–122, XP–002204194, "A New Superclean High Pressure–Low Pressure Rotor Steel for Advanced Combined Cycle Power Plants", 1996.

* cited by examiner

LOW-ALLOY HEAT-RESISTANT STEEL, HEAT TREATMENT METHOD THEREFOR, AND TURBINE ROTOR COMPRISING THE SAME

BACKGROUND OF THE INVENTION

1. Field of the Invention

The present invention relates to low-alloy heat-resistant steels which exhibit excellent performance as large turbine rotor members, heat resistant components for generating plants, and components for devices which are subjected to high temperatures, and relates to heat treatment methods for the low-alloy heat-resistant steels and turbine rotors comprising the low-alloy heat-resistant steels.

2. Description of the Related Art

Conventionally, as heat resistant steels for high temperature turbine rotor members for use in steam turbine plants for thermoelectric power generation, 12Cr steels, which belong to high-Cr steels (see Japanese Patent Applications, First Publications (Kokai), Nos. Sho 60-165359, and Sho 62-103345) and CrMoV steels, which belong to low-alloys (see Japanese Patent Application, First Publication (Kokai), No. Sho 60-70125), have been exclusively used. 12Cr steels have superior high temperature strength and can hence be used in plants having a steam temperature up to 600° C. However, 12Cr steels are disadvantageous in that the production of the material is difficult and costly. Of these, the use of CrMoV steel is restricted to plants having a steam temperature up to 566° C. because of its limited high temperature strength. Moreover, cooling of the rotor may be required depending on the steam temperature, which is disadvantageous in that it complicates the plant.

However, in recent years, further improvement in energy efficiency has been desired, and if it is desired to raise the operational temperature of a steam turbine, a steel of a conventional type is insufficient in mechanical properties at high temperatures, particularly in terms of creep strength. Accordingly, the demand to develop a material which is durable in use at higher steam temperatures has been growing. Conventionally, a CrMoV steel is used after quenching the CrMoV steel heated to a temperature of about 950° C. A higher heating temperature before quenching results in a higher strength of the material because precipitation of a pro-eutectoid ferrite phase, which is soft, is inhibited, and dissolution of the strengthening elements in a solid solution is promoted. However, another problem arises in that a higher heating temperature before quenching causes creep embrittlement of the material. Therefore, the heating temperature before quenching cannot be raised. Although attempts have been made in which elements such as cobalt, niobium, and tantalum, were additionally used in order to inhibit the precipitation of a pro-eutectoid ferrite phase, a satisfactory material has not yet been obtained.

SUMMARY OF THE INVENTION

Accordingly, an object of the present invention is to provide a low-alloy heat-resistant steel in which when it is used to manufacturing a large element, which have uniform superior high temperature properties through a surface layer to a center part. In particular, an object of the present invention is to provide a low-alloy heat-resistant steel which has high creep embrittlement resistance.

Another object of the present invention is to provide a heat treatment method for preparing the novel low-alloy heat-resistant steels.

Another object of the present invention is to provide a turbine rotor comprising the novel heat resistant steel.

In order to achieve the above objects, the present inventors have diligently carried out research and have discovered that the sizes of crystal grains comprising the matrix greatly affects the properties of a steel at high temperatures, particularly the creep embrittlement resistance. That is, the following was discovered. When large elements, such as turbine rotors are cooled in a conventional method, in a center part thereof, since a suitable amount of a pro-eutectaid ferrite phase is easily precipitated, the crystal grains are relatively fine, a high toughness can be obtained, and the creep embrittlement does not occur. In contrast, in the surface layer thereof, since a pro-eutectaid ferrite phase is hard to be precipitated and the crystal grain easily becomes large, the Charpy impact absorbed energy decreases. Thereby, there is the possibility that the material in the surface layer is embrittled and that creep embrittlement occurs.

Consequently, it was also found that the low-alloy heat-resistant steels can be obtained, which have high toughness, excellent high temperatures properties, in particular, in which the creep embrittlement does not occur, and which are suitable for large elements, such as turbine rotors, not only by mixing alloy components in predetermined proportions and minimizing the amount of minor impurity elements which are harmful, but also by adjusting the crystal grain size of the matrix.

First, the measuring method for crystal grain size will be described below. As a measuring method for crystal grain size, Japanese Industrial Standard JIS G 0551 (1998) defines an austenitic grain size determination for steel and JIS G 0552 (1998) defines a ferritic grain size determination for steel. The low-alloy heat-resistant steels of the present invention comprise a metallic structure containing a ferrite phase and a bainite phase which is prepared by quenching from high temperatures, such as an austenitic phase stabilized temperature range, and thereby a pro-eutectoid ferrite phase is precipitated. Therefore, in the present invention, crystal grain size of the composite containing a ferritic phase and a bainite phase is specified. Specifically, in the present invention, the boundary between a bainite phase and a pro-eutectoid ferrite phase, the boundary between pro-eutectoid ferrite phases, and the boundary between austenitic particles which are to be transformed into a bainite phase are defined as the crystal grain boundary, and the size of the area surrounded by the crystal grain boundary is defined as the crystal grain size.

In the present invention, the ferritic grain size determination for steel comprising mixed crystal grains, which is defined by JIS G 0552 (1998), is adopted. In other words, the measuring method is one, in which a photograph of crystal grains which appears at a corroded surface of a test piece is taken using a microscope, and the sizes of the crystal grains are measured by a cross segment method. Moreover, when the crystal grain number is lower, the crystal grain size is larger.

Next, of the high temperature properties, the creep rupture strength of a creep test on a notched test piece (abbreviated as "notched creep test" below) will be described. Since a turbine rotor is subjected to high temperatures for a long time under stress during operation, deterioration in the strength of the material with age is a concern. The quality of turbine rotor members has been hitherto evaluated only by high temperature unnotched creep tests, as defined by the Japanese Industrial Standards or the like. However, the present inventors have discovered a method of evaluating high temperature strength properties of the material, particularly the creep embrittlement resistance, in a high temperature creep test on a notched test piece.

When a stress is applied to a steel product at a high temperature, even if the stress is relatively small, the steel product plastically deforms very gradually to become elongated, and finally the elongation proceeds, rapidly narrowing a part of the steel product, which results in rupture of the steel product. This phenomenon is called "the creep" or "the creep rupture phenomenon". In addition, the cross area ratio between the test piece and the ruptured test piece is called "the creep rupture ratio". In a high temperature creep test, a constant static load is applied to a material for a long time at a high temperature, and the time elapsed before rupture is measured. As a test piece, a round bar having a constant cross section is used. The measuring method is defined by JIS Z-2271. The measuring methods defined by the JIS standards are for creep tests on unnotched test pieces, and test pieces which are finished by smoothly shaving between gauge marks in the portion to be measured are used in these methods.

In contrast, in a creep test on a notched test piece (abbreviated as "notched creep test" below), a test piece having a notch between gauge marks is used. The cross section of the portion (the cross section of the bottom of the notch) to be stretched and subject to measurement is set to be the same as the cross section of the part subject to the measurement in a unnotched creep test, and the stress is determined. In an unnotched creep test, a tensile stress which is applied gradually increases the distance between gauge marks, and narrows the portion between the gauge marks, which finally will rupture. In contrast, if a notch is formed in a test piece, a stress which counteracts deformation of the notched portion is produced such that the stress surrounds the notched portion (this stress is a so-called "multiaxial stress"), and the test piece finally ruptures without being elongated. In general, with a highly ductile material, the lapse of time before rupture tends to be long because deformation is restricted by the notch. However, depending on the type of steel, embrittlement of some materials gradually proceeds during creep tests, and creep rupture may occur in such a material without deformation (by occurrence of voids or by formation of cracks from connected voids). In this case, a notched test piece ruptures in a shorter time than an unnotched test piece due to the concentrated stress. Such a phenomenon is called "notch softening", which can be used as an index for expressing creep embrittlement. That is to say, by conducting creep rupture tests on an unnotched test piece and a notched test piece under the same conditions such as stress and temperature, and comparing the times elapsed before creep rupture, the level of creep embrittlement can be clearly demonstrated. The ratio between the times elapsed before creep rupture in the unnotched creep rupture test and the notched creep rupture test is defined as a creep rupture time ratio.

That is, when the time elapsed before creep rupture in the unnotched creep rupture test is defined as A and that in the notched creep rupture test is defined as B, the creep rupture time ratio is shown by the formula (1).

$$\text{Creep rupture time ratio}=B/A \quad (1)$$

In order to clarify the relationship between the crystal grain size of the matrix and the creep embrittlement, the following tests were carried out.

The crystal grain size was varied by using a test material No. 1, which is in the following Table 1 and which comprises 0.26% by weight of C (in the following, "by weight" is omitted), 0.05% of Si, 0.09% of Mn, 0.08% of Ni, 1.46% of Cr, 0.54% of Mo, 2.40% of W, 0.25% of V, 0.006% of P, 0.001% of S, 0.03% of Cu, 0.003% of Al, 0.006% of As, 0.005% of Sn, and 0.0012% of Sb, and changing a forgoing degree and varying the pre-heat treatment. Then, the test materials were heated to 1050° C. and were subjected to an oil-hardening which simulated a cooling treatment in which the center part and the surface layer far from the surface at 100 mm of the rotor having a drum diameter of 1,200 mm were cooled. After that, the test pieces for characteristics test were obtained by adjusting the tempering temperature so that the strength at an early age (0.2% yield strength) is in a range of from 588 to 647 MPa.

The structure of the test pieces was observed by an optical microscope, and an austenitic grain size number and an amount of a pro-eutectoid ferrite phase were measured. The austenitic grain size number was measured based on JIS G 0551. The results are shown in the following Table 2. In addition, the Charpy impact absorbed energy was measured. Furthermore, a creep test was carried out. In the creep test, creep rupture time at 600° C. and 147 MPa was measured using an unnotched test piece and a notched test piece. The results are shown in the following Table 3.

It is clear from Tables 2 and 3 that an austenitic grain size number of the test pieces Nos. 1—1 to 1–4 is 3.2 or 4.1 and a pro-eutectoid ferrite phase is not precipitated in these test pieces, and Charpy impact absorbed energy thereof is 41 (J) or greater. It is also clear that the creep rupture ratio thereof in the unnotched creep test is 72% or greater, and that these test pieces have high toughness. Moreover, in the notched creep test, the rupture does not occur in these test pieces after 14,000 hours. Therefore, it was confirmed that these test pieces have excellent creep embrittlement properties.

In contrast, the test pieces Nos. 1–5 and 1–6 have small austenitic grain size numbers being 2.3 and 2.5, that is, they have large crystal grains, the Charpy impact absorbed energy thereof is 30 J or less, and the creep rupture ratio in the unnotched creep test is 30.3% or less. Therefore, it is confirmed that the test pieces are embrittled. In addition, the lapse of time before rupture in the notched creep test of the test pieces is 7,500 hours or more, this is longer than that of the test pieces of the present invention. However, in the notched creep test, these test pieces did rupture after 10,000 hours. Therefore, it was confirmed that these test pieces have inferior anti-creep embrittlement properties.

Basically, the materials of the present invention, which have excellent anti-creep embrittlement properties, have creep rupture time ratio (notched creep rupture time/unnotched creep rupture time) is 1.97 or greater. In contrast, the comparative materials, which have inferior anti-creep embrittlement properties, have a creep rupture time ratio of 1.39 or less.

From these results, it is clear that when the crystal grain is large, that is, when the grain size number is small, the Charpy impact absorbed energy decreases, and creep embrittlement is significant. Therefore, it is clear that in order to obtain low-alloy heat-resistant steels having excellent high temperature properties, it is necessary to adjust the crystal grain size such that the grain size number of the bainite phase which is transformed from an austenitic phase is 3.0 or greater.

For example, as materials comprising turbine rotors, materials are suitable which have a 0.2% yield strength of 588 MPa or greater, a Charpy impact absorbed energy at room temperature of 9.8 J or greater, a creep rupture time in the unnotched creep test at 600° C. and 147 MPa of 3,000 hours or greater, a creep rupture time in the notched creep test at 600° C. and 147 MPa of 10,000 hours or greater, a creep rupture time ratio of 1.6 or greater, and an unnotched creep rupture ratio of 50% or greater.

In addition, the manufacturing method for low-alloy heat-resistant steels which are used preferably for large elements, such as turbine rotors, and have the above-mentioned suitable crystal grain size in the center part and the surface layer, was examined. As a result, it was clear that the adjustment of the crystal grain size is effectively carried out by precipitating a suitable amount of the pro-eutectoid ferrite phase and obtaining a composite structure containing the pro-eutectoid ferrite phase and the bainite phase. However, in large elements, since the cooling rate is high in the surface layer and that in the center part is low, if a suitable amount of the pro-eutectoid ferrite phase is made to precipitate in the vicinity of the surface layer, a problem occurs in the center part in that a large amount of the pro-eutectoid ferrite phase, which is not necessary, is precipitated, and the toughness of the element decreases.

The problem can be solved by the first heat treatment method in which a material is heated to high temperatures, such as an austenitize temperature range; after the material is rapidly cooled and quenched, the cooling rate decreases once at a certain temperature, and thereby the temperature difference between in the center part and in the surface layer decreases, that is, the center part is cooled slowly, and thereby a suitable amount of the pro-eutectoid ferrite phase is made to precipitate in the center part; after that, the material is rapidly cooled again. According to the first heat treatment method, a metallic structure, in which the average crystal grain size in the surface layer substantially equals that in the center part, can be obtained.

In addition, the problem can also be solved by the second heat treatment method in which a material is heated to high temperatures, such as into an austenitize temperature range; the material is cooled with a relatively low cooling rate over high temperatures, and thereby a suitable amount of the pro-eutectoid ferrite phase is made to precipitate in the surface layer; after that the material is cooled at a relatively high cooling rate over low temperatures, and thereby the toughness of the material is increased. According to the second heat treatment method, a metallic structure, in which the size of the crystal grain and the pro-eutectoid ferrite phase in the surface layer substantially equals those in the center part, can be obtained.

The metallic structure of the materials which are heat treated in the first and second heat treatment methods comprise the bainite phase structure in which the pro-eutectoid ferrite phase is precipitated. In the pro-eutectoid ferrite phase, carbonitrides of the matrix reinforcing elements, such as Mo, W, V, and the like, are finely dispersed and precipitated by tempering. The pro-eutectoid ferrite phase has been believed to be soft and it was believed that it makes the toughness of the material decrease, and the pro-eutectoid ferrite phase should not be precipitated as much as possible. In contrast, in the present invention, after the pro-eutectoid ferrite phase is reinforced by using the matrix reinforcing elements and a suitable amount of the pro-eutectoid ferrite phase is precipitated, the pro-eutectoid ferrite phase is used effectively to reduce the sizes of the crystal grains.

The turbine rotors comprising such low-alloy heat-resistant steels of the present invention, which are manufactured by such heat treatment methods, comprise a metallic structure in which crystal grain sizes in the surface layer substantially equal those in the center part, and the crystal grain size is most suitable, and the turbine rotors have high strength and toughness at low temperatures and have high temperature properties. Therefore, the turbine rotors do not experience creep embrittlement. In addition, since large elements can also be simply heat treated, the manufacturing cost can be reduced, and the manufacturing time can also be shortened.

In other words, in order to achieve the objects, the present invention provides a first low-alloy heat-resistant steel comprising:

carbon in an amount of 0.20 to 0.35%,
silicon in an amount of 0.005 to 0.35%,
manganese in an amount of 0.05 to 1.0%,
nickel in an amount of 0.05 to 0.3%,
chromium in an amount of 0.8 to 2.5%,
molybdenum in an amount of 0.1 to 1.5%,
tungsten in an amount of 0.1 to 2.5%,
vanadium in an amount of 0.05 to 0.3%,
phosphorus in an amount not greater than 0.012%,
sulfur in an amount not greater than 0.005%,
copper in an amount not greater than 0.10%,
aluminum in an amount not greater than 0.01%,
arsenic in an amount not greater than 0.01%,
tin in an amount not greater than 0.01%,
antimony in an amount not greater than 0.003%, and
the balance being iron and unavoidable impurities, and containing a metallic structure having an austenitic grain size number in a range of from 3 to 6.

According to the first low-alloy heat-resistant steel, the creep properties are improved by adding tungsten into conventional CrMoV steels. In addition, the creep properties, in particular, the creep embrittlement resistance, is improved by minimizing the permissible amount of minor impurity elements, such as P, S, Cu, Al, As, Ti, Sb, and the like, which are harmful in causing creep embrittlement, and adjusting an austenitic grain size number of the crystal grain into a range of from 3 to 6.

In order to achieve the objects, the present invention provides a second low-alloy heat-resistant steel comprising:

carbon in an amount of 0.20 to 0.35%,
silicon in an amount of 0.005 to 0.35%,
manganese in an amount of 0.05 to 1.0%,
nickel in an amount of 0.05 to 0.3%,
chromium in an amount of 0.8 to 2.5%,
molybdenum in an amount of 0.05 to 1.5%,
tungsten in an amount of 0.01 to 2.5%, vanadium in an amount of 0.05 to 0.3%, cobalt in an amount of 0.1 to 3.5%, phosphorus in an amount not greater than 0.012%, sulfur in an amount not greater than 0.005%, copper in an amount not greater than 0.10%, aluminum in an amount not greater than 0.01%, arsenic in an amount not greater than 0.01%, tin in an amount not greater than 0.01%, antimony in an amount not greater than 0.003%, and the balance being iron and unavoidable impurities, and containing a metallic structure having an austenitic grain size number in a range of from 3 to 6.

In the second low-alloy heat-resistant steel, cobalt is added into the first low-alloy heat-resistant steel. Thereby, the toughness thereof is more improved. In addition, similar to the first low-alloy heat-resistant steel, the creep properties, in particular, the creep embrittlement resistance is improved by minimizing the permissible amount of minor impurity elements, such as P, S, Cu, Al, As, Ti, Sb, and the like, which are harmful in causing creep embrittlement, and adjusting an austenitic grain size number of the crystal grain into a range of from 3 to 6.

In addition, in order to achieve the objects, the present invention provides a third low-alloy heat-resistant steel comprising:

carbon in an amount of 0.20 to 0.35%, silicon in an amount of 0.005 to 0.35%, manganese in an amount of 0.05 to 1.0%, nickel in an amount of 0.05 to 0.3%, chromium in an amount of 0.8 to 2.5%, molybdenum in an amount of 0.1 to 1.5%, tungsten in an amount of 0.1 to 2.5%, vanadium in an amount of 0.05 to 0.3%, at least one of niobium in an amount of 0.01 to 0.15%, tantalum in an amount of 0.01 to 0.15%, nitrogen in an amount of 0.001 to 0.05%, and boron in an amount of 0.001 to 0.015%, phosphorus in an amount not greater than 0.012%, sulfur in an amount not greater than 0.005%, copper in an amount not greater than 0.10%, aluminum in an amount not greater than 0.01%, arsenic in an amount not greater than 0.01%, tin in an amount not greater than 0.01%, antimony in an amount not greater than 0.003%, and the balance being iron and unavoidable impurities, and containing a metallic structure having an austenitic grain size number in a range of from 3 to 6.

In the third low-alloy heat-resistant steel, at least one of niobium, tantalum, nitrogen, and boron are added into the first low-alloy heat-resistant steel. Thereby, the unnotched creep properties thereof are further improved. In addition, similar to the first low-alloy heat-resistant steel, the creep properties, in particular, the creep embrittlement resistance, is improved by minimizing a permissible amount of minor impurity elements, such as P, S, Cu, Al, As, Ti, Sb, and the like, which are harmful in causing creep embrittlement, and adjusting an austenitic grain size number of the crystal grain into a range of from 3 to 6.

In addition, in order to achieve the objects, the present invention provides a fourth low-alloy heat-resistant steel comprising:

carbon in an amount of 0.20 to 0.35%, silicon in an amount of 0.005 to 0.35%, manganese in an amount of 0.05 to 1.0%, nickel in an amount of 0.05 to 0.3%, chromium in an amount of 0.8 to 2.5%, molybdenum in an amount of 0.1 to 1.5%, tungsten in an amount of 0.1 to 2.5%, vanadium in an amount of 0.05 to 0.3%, cobalt in an amount of 0.1 to 0.3%, at least one of niobium in an amount of 0.01 to 0.15%, tantalum in an amount of 0.01 to 0.15%, nitrogen in an amount of 0.001 to 0.05%, and boron in an amount of 0.001 to 0.015%, phosphorus in an amount not greater than 0.012%, sulfur in an amount not greater than 0.005%, copper in an amount not greater than 0.10%, aluminum in an amount not greater than 0.01%, arsenic in an amount not greater than 0.01%, tin in an amount not greater than 0.01%, antimony in an amount not greater than 0.003%, and the balance being iron and unavoidable impurities, and containing a metallic structure having an austenitic grain size number in a range of from 3 to 6.

In the fourth low-alloy heat-resistant steel, cobalt and at least one of niobium, tantalum, nitrogen, and boron are added into the first low-alloy heat-resistant steel. Thereby, the toughness and the unnotched creep properties thereof are further improved. In addition, similar to the first low-alloy heat-resistant steel, the creep properties, in particular, the creep embrittlement resistance, is improved by minimizing a permissible amount of minor impurity elements, such as P, S, Cu, Al, As, Ti, Sb, and the like, which are harmful in causing creep embrittlement, and adjusting an austenitic grain size number of the crystal grain into a range of from 3 to 6.

In these low-alloy heat-resistant steels, it is preferable to contain a composite structure which mainly contains the bainite phase and the pro-eutectoid ferrite phase.

According to the low-alloy heat-resistant steels, the toughness and the creep embrittlement resistant of these steels are improved by precipitating a suitable amount of the pro-eutectoid ferrite phase and effectively using it to adjust the average crystal grain size, while the necessary strength is maintained.

In these low-alloy heat-resistant steels, it is preferable for the pro-eutectoid ferrite phase to be contained in a range of from 5 to 40% by volume.

Since the pro-eutectoid ferrite phase which is usually precipitated in ordinary low-alloy heat-resistant steels is soft, when a large amount of the pro-eutectoid ferrite phase is precipitated, it is difficult to maintain the strength at an early age (0.2% yield strength) and the creep strength high. In addition, since the toughness of the pro-eutectoid ferrite phase is smaller than that of the bainite phase which is an aggregate comprising fine needle structures, when a large amount of the pro-eutectoid ferrite phase is precipitated, the toughness of the material also decreases. Therefore, it has been believed that the pro-eutectoid ferrite phase should, as much as possible not be precipitated. In contrast, in the present invention, after the pro-eutectoid ferrite phase is reinforced by using the matrix reinforcing elements and a suitable amount of the pro-eutectoid ferrite phase is precipitated, the pro-eutectoid ferrite phase is used effectively to reduce the sizes of the crystal grain. Thereby, the toughness and the creep embrittlement resistance are improved. From this point of view, a suitable amount of the pro-eutectoid ferrite phase to be precipitated is specified in the above range.

In addition, in these low-alloy heat-resistant steels, it is preferable for the pro-eutectoid ferrite phase to contain a metallic structure in which carbonitride phases are finely dispersed.

According to these low-alloy heat-resistant steels, it is possible to reinforce the pro-eutectoid ferrite phase and to increase the creep strength of the pro-eutectoid ferrite phase to a level of the creep strength of the bainite phase. Therefore, these low-alloy heat-resistant steels have excellent low temperatures and high temperatures properties. In particular, these low-alloy heat-resistant steels can be used to make large parts.

In other words, the low-alloy heat-resistant steels of the present invention can be easily manufactured. In particular, in the low-alloy heat-resistant steels of the present invention, the quenching from 1,000° C. or greater can be proceeded. Due to this, the metallic structure in the center part thereof equals that in the surface layer. Therefore, the low-alloy heat-resistant steels of the present invention have yield strength and toughness, which equal or greater than those of the conventional CrMoV steels, and excellent high temperature properties. In particular, creep embrittlement does not occur in the low-alloy heat-resistant steels of the present invention. Therefore, the low-alloy heat-resistant steels of the present invention are suitable for the materials of turbine rotors.

In order to achieve the objects, the present invention provides a first heat treatment method for a low-alloy heat-resistant steel, comprising the steps of:

heating a steel ingot in a range of from 1,000 to 1,100° C., which comprises carbon in an amount of 0.20 to 0.35%, silicon in an amount of 0.005 to 0.35%, manganese in an amount of 0.05 to 1.0%, nickel in an amount of 0.05 to 0.3%, chromium in an amount of 0.8 to 2.5%, molybdenum in an amount of 0.1 to 1.5%, tungsten in an amount of 0.1 to 2.5%, vanadium in an amount of 0.05 to 0.3%, and the balance being iron and unavoidable impurities;

cooling the steel ingot to a certain temperature in a range of from 900 to 700° C. by spray-quenching and/or air-blast quenching, air cooling for from 5 minutes to 5 hours, cooling again by at least one method consisting of spray-quenching, air-blast quenching, and oil quenching.

In the first heat treatment method, the steel ingot at high temperatures is rapidly cooled and quenched, and after that, the steel ingot is left in the air and is thereby air cooled. Due to this, the cooling rate in the surface layer decreases, and temperature difference between in the surface layer and in the center part decreases. As a result, a suitable amount of the pro-eutectoid ferrite phase is precipitated in the surface layer.

In order to achieve the objects, the present invention provides a second heat treatment method for a low-alloy heat-resistant steel comprising the steps of:

heating a steel ingot in a range of from 1,000 to 1,100° C., which comprises carbon in an amount of 0.20 to 0.35%, silicon in an amount of 0.005 to 0.35%, manganese in an amount of 0.05 to 1.0%, nickel in an amount of 0.05 to 0.3%, chromium in an amount of 0.8 to 2.5%, molybdenum in an amount of 0.1 to 1.5%, tungsten in an amount of 0.1 to 2.5%, vanadium in an amount of 0.05 to 0.3%, and the balance being iron and unavoidable impurities;

cooling the steel ingot to a certain temperature in a range of from 800 to 600° C. with an average cooling rate of 2° C./min or less; and cooling to 300° C. with an average cooling rate in a range of from 2 to 15° C./min.

In the second heat treatment method, the steel ingot at high temperatures is cooled at a relatively low cooling rate. During cooling, the pro-eutectoid ferrite phase is precipitated in not only the center part but also in the surface layer. After that, the steel ingot is quenched by increasing the cooling rate.

In the heat treatment methods, it is preferable for the steel ingot to further comprise at least one of niobium in an amount of 0.01 to 0.15%, tantalum in an amount of 0.01 to 0.15%, cobalt in an amount of 0.1 to 3.5%, nitrogen in an amount of 0.001 to 0.05%, and boron in an amount of 0.001 to 0.015%.

According to the heat treatment methods, since such minor elements are added, the crystal grain is fine, and the creep strength thereof is improved.

In addition, in the heat treatment methods, it is preferable that phosphorus be contained in an amount not greater than 0.012%, sulfur be contained in an amount not greater than 0.005%, copper be contained in an amount not greater than 0.10%, aluminum be contained in an amount not greater than 0.01%, arsenic be contained in an amount not greater than 0.01%, tin be contained in an amount not greater than 0.01%, and antimony be contained in an amount not greater than 0.003%, which are impurities contained in the steel ingot.

According to the heat treatment methods, since the allowable range of these minor impurities is limited as above, creep embrittlement can be avoided.

In addition, according to the heat treatment methods of the present invention, even when the material is large, the metallic structure in the surface layer and in the center part of the material can be uniformly by adjusting the cooling rate. The adjustment of the cooling rate is easily carried out. In addition, it is possible to adjust the crystal grain size number into a range of from 3 to 6. Therefore, according to the heat treatment method of the present invention, it is possible to provide materials, which have sufficient yield strength for large elements, high toughness, and excellent high temperature properties, in particular, high creep embrittlement resistant, in a short manufacturing period with low cost.

In addition, in order to achieve the objects, the present invention provides a turbine rotor comprising the low-alloy heat-resistant steel.

According to the turbine rotor, even when the turbine rotor is large, the turbine rotor has relatively uniform high temperature properties throughout the entire turbine rotor. Therefore, the turbine rotor can be used at high temperatures which are higher than conventional service temperatures. Due to this, it is possible to provide an electric power plant having a high energy efficiency. In addition, since the heat treatment, which is used for the turbine rotor, is simple, the manufacturing cost for turbine rotors can be reduced.

Furthermore, the turbine rotors of the present invention are effective for reducing the cost required to generate electric power.

DETAILED DESCRIPTION OF THE PREFERRED EMBODIMENTS

Figure 1:
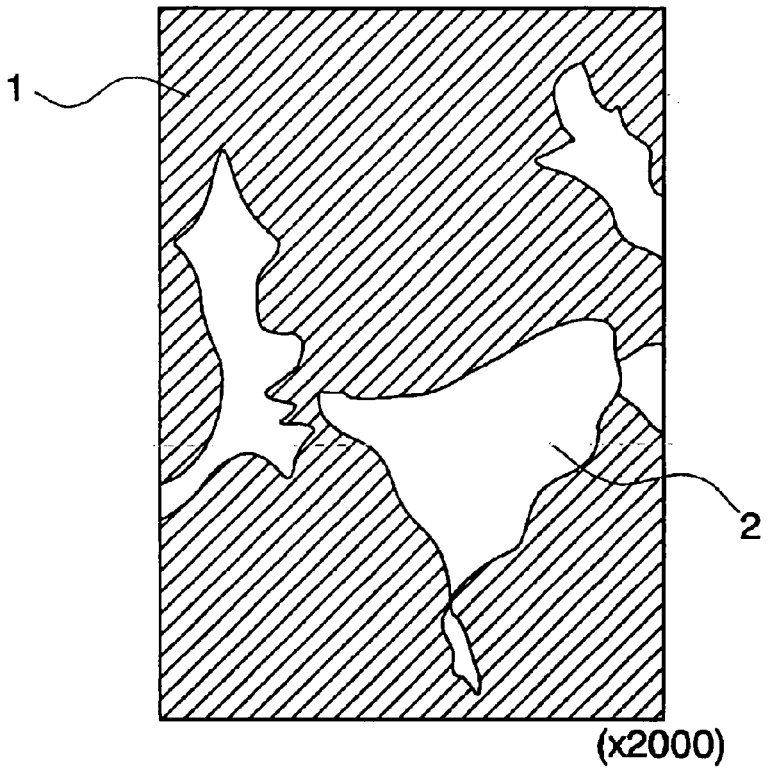
FIG. 1 is a diagram of the microphotograph showing the metallic structure of the test piece before the tempering.

In the following, the reasons for limiting the amounts of each component in the low-alloy heat-resistant steels of the present invention is described. The amounts of the components are expressed hereinafter on the basis of weight percentages unless otherwise specified.

Carbon (C): Carbon has the effect of increasing material strength as well as ensuring hardenability during the heat treatment. In addition, carbon forms a carbonide and contributes to improvement of the creep rupture strength at high temperatures. In the low-alloy heat-resistant steels of the present invention, the lower limit of the carbon content is 0.20% since a carbon content of less than 0.02% does not impart sufficient material strength to the alloys. On the other hand, an excess of carbon content deteriorates the toughness, and while the alloy is being used at a high temperature, carbonitride aggregates to form coarse grains, which causes degradation in the creep rupture strength and creep embrittlement. Accordingly, the upper limit of the carbon content is 0.35%. A particularly preferred range within which both material strength and the toughness are imparted to the alloy is from 0.25 to 0.30%.

Silicon (Si): Si is an element which is effective as a deoxidizer but embrittles the matrix. When a deoxidizing effect is desired, a Si content of up to 0.35% is permissible. However, in the method of the present invention, there are some cases in which the deoxidizing effect of silicon is not strongly desired, depending on the manufacturing method. In such a case, the silicon content can be minimized. However, since extreme reduction of silicon requires a careful selection of materials, and therefore brings about a higher cost, the lower limit of the silicon content is 0.005%. Accordingly, the range of the silicon content is from 0.005 to 0.35%. A preferable range is from 0.01 to 0.30%.

Manganese (Mn): Manganese functions as a deoxidizer as well as having the effect of preventing hot cracks during forging. In addition, manganese has the effect of enhancing the hardenability during heat treatment. However, since too large a manganese content deteriorates the creep rupture strength, the upper limit of the manganese content is 1.0%. However, since limiting the manganese content to less than 0.05% requires careful selection of materials and excessive refining steps, and therefore brings about a higher cost, the lower limit of the manganese content is 0.05%. Accordingly, the range of the manganese content is from 0.05 to 1.0%, preferably from 0.1 to 0.8%.

Nickel (Ni): Nickel particularly has the effect of enhancing the toughness as well as enhancing the hardenability during the heat treatment and improving the tensile strength and the yield strength. If the nickel content is less than 0.05%, these effects are not discernible. On the other hand, a large amount of added nickel reduces the long-term creep rupture strength. For the low-alloy heat-resistant steel of the present invention, improvement of the hardenability, the toughness, and the like by the addition of nickel is not strongly relied upon but instead, in order to eliminate the harmful effect of nickel on the long-term creep rupture strength, the upper limit of the nickel content is 0.3%. Taking into account the balance between this harmful effect and the effect of enhancing the toughness, the range of the nickel content is from 0.05 to 0.3%, preferably from 0.08 to 0.20%.

Chromium (Cr): Chromium enhances the hardenability of the alloy during the heat treatment as well as contributes to improvement of the creep rupture strength by forming a carbonitride and improving the antioxidation effect by dissolving in the matrix of the alloy. In addition, chromium has the effect of strengthening the matrix itself and improving the creep rupture strength. A chromium content of less than 0.8% does not provide a sufficient effect, and a chromium content exceeding 2.5% has the adverse effect of reducing the creep rupture strength. Accordingly, the range of the chromium content is from 0.8 to 2.5%, preferably from 1.0 to 1.5%.

Molybdenum (Mo): Molybdenum enhances the hardenability of the alloy during the heat treatment as well as improves the creep rupture strength by dissolving in the matrix of the alloy or in a carbonitride. If the molybdenum content is less than 0.1%, these effects are not sufficiently discernible. Addition of molybdenum exceeding 2.0% has the adverse effect of deteriorating the toughness and brings about a higher cost. Accordingly, the molybdenum content is from 0.1 to 1.5%, preferably 0.5 to 1.5%.

Vanadium (V): Vanadium enhances the hardenability of the alloy during the heat treatment as well as improves the creep rupture strength by forming a carbonitride. A vanadium content of less than 0.05% does not provide a sufficient effect. In addition, a vanadium content exceeding 0.3% has the opposite effect of deteriorating the creep rupture strength. Accordingly, the vanadium content is from 0.05 to 0.3%, preferably from 0.15 to 0.25%.

Tungsten (W): Tungsten dissolves in the matrix of the alloy or a carbonitride to improve the creep rupture strength. If the tungsten content is less than 0.1%, the above effect is not sufficient. If the tungsten content exceeds 2.5%, there is a possibility of segregation in the alloy, and a ferrite phase tends to emerge, which deteriorates the strength. Accordingly, the tungsten content is from 0.1 to 2.5%, preferably 1.0 to 2.4%.

Next, an explanation with regard to phosphorus, sulfur, copper, aluminum, arsenic, tin, and antimony, which are harmful impurities, will be given. Of course, the lower the amounts of these impurities, the better the mechanical properties of the steel product. However, elements for which permissible amounts contained as impurities in a steel product are standardized are only phosphorus and sulfur, which are inevitably transferred from the materials used for steel production. Since phosphorus and sulfur embrittle the steel product, permissible amounts of phosphorus and sulfur are established for most types of steel products, which are at considerably high levels in view of difficulty of the refining processes. As a result of diligent research aimed at improvement of the high temperature properties of a CrMoV steel for turbine rotors, particularly improvement of the creep rupture strength of a notched test piece, the present inventors have found that trace impurities greatly affect the creep rupture strength of a notched test piece. As such impurities, not only phosphorus and sulfur, but also copper, aluminum, arsenic, tin, antimony, and the like were also found to have harmful effects. The present inventors have studied these impurities in detail and have decided to specifically quantify the permissible amounts in an effort to achieve a rupture time of 10,000 hours or longer in a notched creep test under the conditions of a temperature of 600° C. and a stress of 147 MPa.

Phosphorus (P), Sulfur (S): Both phosphorus and sulfur are impurities transferred from materials for steel production, and are harmful impurities which noticeably deteriorate the toughness of the steel product by forming a phosphide or a sulfide therein. In the research conducted by the inventors, it was found that phosphorus and sulfur also adversely affect the high temperature properties. Phosphorus tends to be segregated, and secondarily causes segregation of carbon which embrittles the steel product. It was also found that phosphorus greatly affects the embrittlement when a high load is applied at a high temperature over a long period. Since extreme reduction of phosphorus and sulfur is a large burden on the steel production process, the upper limits of phosphorus and sulfur were sought such that the rupture time in a creep test on a notched test piece is 10,000 hours or longer. As a result, it has been determined that the upper limit of phosphorus is 0.012%, and the upper limit of sulfur is 0.005%. More preferably, phosphorus is 0.010% or less, and sulfur is 0.002% or less.

Copper (Cu): Copper is diffused along crystal grain boundaries in the steel product, and embrittles the steel product. Copper particularly degrades high temperature properties. In view of the results of creep tests on notched test pieces, it has been determined that the upper limit of the copper content is 0.10%. More preferably, the copper content is 0.04% or less.

Aluminum (Al): Aluminum is introduced into steel mainly from deoxidizers during the steel production process, and forms an oxide-type inclusion in the steel product, which embrittles it. In view of the results of creep tests on notched test pieces, it has been determined that the upper limit of the aluminum content is 0.01%. More preferably, the copper content is 0.005% or less.

Arsenic (As), Tin (Sn), Antimony (Sb): It is often the case that arsenic, tin, and antimony are introduced into the steel from materials for steel production. They are precipitated along crystal grain boundaries, which deteriorates the toughness of the steel product. Arsenic, tin, and antimony are aggregated in crystal grain boundaries particularly at high temperatures, and accelerate the embrittlement. In view of the results of creep tests on notched test pieces, the upper limits of these impurities are 0.01% for arsenic, 0.01% for tin, and 0.003% for antimony. More preferably, the arsenic content is 0.007% or less, the tin content is 0.007% or less, and the antimony content is 0.0022% or less.

Next, the reason for limiting the amount of cobalt, niobium, tantalum, nitrogen, and boron, which are optional elements, is explained below.

Cobalt (Co): Cobalt dissolves in the matrix of the alloy, and strengthens the matrix itself as well as inhibits the precipitation of the ferrite phase. In addition, cobalt has an effect of improving the toughness, and thus is effective in maintaining the balance between the hardness and the toughness. If the amount of cobalt added is less than 0.1%, the above effects are not discernible. If the amount of cobalt added exceeds 3.5%, precipitation of carbonitride is accelerated, which leads to deterioration of the creep properties. Accordingly, a permissible range of the cobalt content is from 0.1% to 3.5%, and more preferably from 0.5% to 2.5%.

Niobium (Nb): Niobium enhances the hardenability of the alloy as well as improves the creep rupture strength by forming a carbide and/or a nitride. In addition, niobium restricts the growth of crystal grains during heating at high temperatures, and contributes to homogenization of the alloy structure. If the amount of niobium added is less than 0.01%, the effects are not discernible. An amount of niobium added exceeding 0.15% will bring about noticeable deterioration of the toughness as well as cause formation of coarse grains of the carbide or the carbonitride of niobium during use of the alloy, which deteriorates long-term creep rupture strength. Accordingly, it has been determined that a permissible niobium content is from 0.01% to 0.15%, preferably 0.05 to 0.1%.

Tantalum (Ta): Tantalum, in a manner similar to niobium, enhances the hardenability of the alloy as well as improves the creep rupture strength by forming a carbonitride. If the amount of tantalum added is less than 0.01%, the effects are not discernible. An amount of tantalum added exceeding 0.15% will bring about noticeable deterioration of the toughness as well as cause formation of coarse grains of the carbonitride of niobium during use of the alloy, which deteriorates long-term creep rupture strength. Accordingly, it has been determined that a permissible tantalum content is from 0.01% to 0.15%, preferably 0.05 to 0.1%.

Nitrogen (N): Nitrogen together with carbon is bonded to alloy elements and forms carbonitrides, which contribute to improvement of the creep rupture strength. If the amount of nitrogen added is less than 0.001%, nitrides cannot be formed, and thus the above effects are not discernible. If the amount of nitrogen added exceeds 0.05%, carbonitrides are aggregated to form coarse grains, and thus a sufficient creep strength cannot be obtained. Accordingly, it has been determined that a permissible nitrogen content is from 0.001 to 0.05%, preferably 0.005 to 0.01%.

Boron (B): Boron enhances the hardenability as well as contributes to improvement of the creep rupture strength by increasing the grain boundary strength. If the amount of boron added is less than 0.001%, the above effects are not discernible. If the amount of boron added exceeds 0.015%, an adverse effect of deteriorating the hardenability occurs. Accordingly, it has been determined that the permissible boron content is from 0.001% to 0.015%, preferably 0.003 to 0.010%.

Below, a metallic structure of the low-alloy heat-resistant steels of the present invention will be explained.

The low-alloy heat-resistant steels of the present invention are prepared by heating to 1,000° C. or greater which is higher than the heating temperature of conventional CrMoV steels, quenching, and tempering. In the overall process, during the cooling, the pro-eutectoid ferrite phase is precipitated from the austenitic phase. When the precipitation of the pro-eutectoid ferrite phase is completed, the austenitic phase is transformed into the bainite phase at lower temperatures. Then, when the tempering is carried out, carbide, nitride, and carbonitride of the matrix reinforcing elements are finely dispersed and precipitated in the pro-eutectoid ferrite phase. Therefore, a metallic structure of the low-alloy heat-resistant steel of the present invention is a composite structure containing a bainite phase and a pro-eutectoid ferrite phase. In the pro-eutectoid ferrite phase, carbonitrides are finely dispersed. The structure in which carbonitrides are dispersed in the pro-eutectoid ferrite phase is a characteristic of the present invention. In the characteristic structure, the crystal grain is finer than the austenitic crystal grain which is the crystal grain before the transformation. In other words, it is necessary for the average size of the pro-eutectoid ferrite grain and the bainite grain, which equals the size of the austenitic grain at a point in time at which the precipitation of the pro-eutectoid ferrite phase is completed, to be adjusted so that the crystal grain number thereof is in a range of from 3 to 6. When the crystal grain number is less than 3, the crystal grain is too large, and creep embrittlement may occur. In contrast, when the crystal grain number is larger than 6, the crystal grain is too small, and the high temperature properties decrease. Therefore, the crystal grain number of the crystal grain is preferably in a range of from 3 to 6, and more preferably in a range of from 3.2 to 4.5.

In addition, in the low-alloy heat-resistant steels of the present invention, it is confirmed that the carbonitride phase is finely dispersed into the pro-eutectoid ferrite phase. The carbonitride phase comprises the carbonitride of the matrix reinforcing elements, such as Mo, W, and V. In addition, the carbonitride phase may comprise the carbonitride of the minor elements, such as Nb and Ta. Furthermore, Fe or Cr may dissolve into the carbonitride phase. As long as these carbonitrides are finely dispersed, they have the effect for reinforcing the pro-eutectoid ferrite phase, which has been believed to be soft. This is effective for improving the anti-creep properties.

In the present invention, the creep embrittlement is prevented by precipitating the pro-eutectoid ferrite phase, and thereby the size of the crystal grains in the metallic structure is adjusted, while excellent high temperatures strength is maintained.

Since the pro-eutectoid ferrite phase has a structure having a toughness which is less than that of the bainite phase comprising fine needle structures, if a large amount of the pro-eutectoid ferrite phase is precipitated, the toughness decreases. In addition, the pro-eutectoid ferrite phase is reinforced by the fine carbonitrides, but it is soft compared with the bainite phase. Therefore, if a large amount of the pro-eutectoid ferrite phase is precipitated, the material strength, in particular, 0.2% yield strength is insufficient. Due to this, it is preferable for the amount of the pro-eutectoid ferrite phase to be in a range of from 5 to 40% by volume. When the amount of the pro-eutectoid ferrite phase is less than 5% by volume, it is difficult to adjust the crystal grain in the surface layer and the center part into a suitable range. In contrast, when the amount is larger than 40% by volume, the toughness decreases and sufficient material strength can be obtained. Therefore, the amount of the pro-eutectoid ferrite phase is preferably in a range of from 5 to 40% by volume, more preferably in a range of from 10 to 30% by volume, and most preferably in a range of from 15 to 25% by volume.

Moreover, the ratio of the pro-eutectoid ferrite phase with respect to the structure can be measured by an ordinary image analysis device.

In addition, when the creep rupture time ratio of the material is large, creep embrittlement is unlikely to occur. Therefore, when the low-alloy heat-resistant steels of the present invention are used for large elements, such as turbine rotors, the creep rupture time ratio is preferably 1.6 or greater.

Next, the heat treatment methods, that is, the manufacturing methods for low alloy heat-resistant steels of the present invention, will be explained.

In the manufacturing method for the low-alloy heat-resistant steel, first, a matrix is melted and produced so as to have a predetermined alloy composition. A method for reducing the minor impurities is not particularly limited, and various well-known refining methods, including careful selection of raw materials, can be employed. Then, an alloy melt with a predetermined composition is cast by a well-known method to form a steel ingot, which is subjected to a predetermined forging/molding process to produce a low-alloy heat-resistant steel comprising crystal grains having a desired size. In order to adjust the crystal grain size, the pro-eutectoid ferrite phase is precipitated by adjusting the cooling rate. Due to this operation, it is easy to maintain the crystal grain size such that the crystal grain size number is 3.0 or greater. According to the heat treatment method of the present invention, it is possible to maintain the crystal grain size number at 3.0 or greater without complicated processes.

The temperature in the heat treatment method of the present invention is controlled at the position of the material corresponding to the top surface layer of the final product having a final product configuration. Since the material, which is subjected to the heat treatment, has pads in a range of from about 30 to 200 mm, the temperature is controlled at the position of the material, which corresponds to the top surface layer of the final product in which the pads are eliminated. In order to control the temperature, it is possible to freely select a temperature control method, such as a direct method in which the temperature at the position to be controlled is directly measured and is controlled; an indirect method in which a temperature relationship between the position to be controlled and the other position is known in advance, and the temperature at the position to be controlled is controlled depending on the temperature at the other position; and another method using data which are gathered in advance or which are obtained by simulations.

In the first heat treatment method, the material is heated to a range of from 1,000 to 1,100° C., preferably to an austenitize temperature range, such as a range of from 1,030 to 1070° C.; the material is cooled to a certain temperature in a range of from 700 to 900° C. by a spray-quenching and/or an air-blast quenching; the cooling is stopped once, and the material is air cooled by being allowed to stand in the air for a certain period of from 5 minutes to 5 hours; then the material is cooled again by at least one method consisting of a spray-quenching, an air-blast quenching, and an oil quenching.

The certain temperature in a range of from 700 to 900° C. is varied depending on the alloy composition, the size, the shape and the like of the material.

While the material is at a high temperature, that is, while the material is cooled to the certain temperature in a range of from 700 to 900° C., in the surface layer of the material, since the material is rapidly cooled, the austenitic state is maintained. However, in the center part of the material, since the material is gradually cooled, the pro-eutectoid ferrite phase is precipitated. While the material is cooled to the certain temperature in a range of from 700 to 900° C., the average cooling rate is in a range of from 2 to 15° C./min, and more preferably in a range of from 5 to 15° C./min. When large elements, such as turbine rotors, are manufactured, the real maximum cooling rate is 15° C./min. Therefore, the maximum average cooling rate is 15° C./min. When the average cooling rate is less than 2° C./min, since a large amount of the pro-eutectoid ferrite phase is precipitated before reaching the temperature at which cooling stops, sufficient material strength cannot be maintained. Therefore, the minimum cooling rate is preferably 2° C./min.

This cooling rate is achieved by a spray-quenching and/or an air-blast quenching. In the spray-quenching, the cooling rate can be adjusted by varying the flow rate of water, depending on the size and the shape of the material. In addition, the spray-quenching includes so-called fog quenching in which water is sprayed as a fog.

After that, the cooling is stopped once at a certain temperature in a range of from 700 to 900° C., and the material is air cooled by being allowed to stand in the air. In this process, a self-cooling by air-cooling is basically carried out. However, any cooling method and temperature maintaining method can be adopted. In addition, the cooling rate is not limited in this process. However, if a preferable cooling rate is specified, a cooling rate of 2° C./min or less is preferable. The period in which the cooling is stopped is in a range of from 5 minutes to 5 hours. The period is varied depending on the alloy composition, the size, the shape, and the like of the material. In this process, since the temperature difference between in the surface layer and in the center part is reduced, that is, since the surface layer is also gradually cooled, a suitable amount of the pro-eutectoid ferrite phase is precipitated both in the surface layer and in the center part.

After the precipitation of a suitable amount of the pro-eutectoid ferrite phase is almost completed, the cooling rate increases again, and thereby sufficient material strength can be obtained.

Cooling from the certain temperature in a range of from 700 to 900° C. down to 300° C. is important. In this temperature range, the cooling rate is preferably in a range of from 2 to 15° C./min, and more preferably in a range of from 5 to 15° C./min. This cooling rate is achieved by at least one method selected from a spray-quenching, an air-blast quenching, and an oil quenching. In this temperature range, the real maximum cooling rate is 15° C./min. When the average cooling rate is less than 2° C./min, the pro-eutectoid ferrite phase is precipitated during cooling, and the control of the precipitation amount of the pro-eutectoid ferrite phase is difficult. Therefore, the cooling rate from the certain temperature in a range of from 700 to 900° C. down to 300° C. is preferably the above range.

After the precipitation of the pro-eutectoid ferrite phase is completed, that is, when the temperature is 300° C. or less, the cooling rate is not limited and is freely selected.

After these treatments, the low-alloy heat-resistant steel is further tempered so that 0.2% yield strength (strength at an early age) is in a range of from 588 to 647 MPa, and thereby the desired steel is prepared.

The heat treatment is effective to control the metallic structure of the low-alloy heat-resistant steel, in particular, the metallic structure of the low-alloy heat-resistant steel of the present invention, in which the pro-eutectoid ferrite phase is easily precipitated and of which the composition is shown in Table 1.

Since the low-alloy heat-resistant steel of the present invention contains a large amount of alloy elements and it is quenched from a high temperature which is higher than a conventional quenching temperature, after the tempering, fine carbonitride phases are precipitated into the pro-eutectoid ferrite phase. Compared with an ordinary pro-eutectoid ferrite phase, the prepared pro-eutectoid ferrite phase is hard and it has excellent creep resistance, and creep embrittlement does not occur. Therefore, when the low-alloy heat-resistant steel of the present invention contains about 35% of the pro-eutectoid ferrite phase, it has excellent strength at an early age (0.2% yield strength) and creep rupture strength. In addition, since the amount of the ferrite phase having low toughness increases, but the fine crystal grain effects can be obtained, large decrease of the Charpy impact absorbed energy of the low-alloy heat-resistant steel of the present invention does not occur.

Next, in the second heat treatment method, the material is heated to a range of from 1,000 to 1,100° C., preferably to an austenitize temperature range, such as to a range of from 1,030 to 1,050° C.; and the material is cooled to a certain temperature in a range of from 600 to 800° C. at a cooling rate lower than 2° C./min. After that, from the certain temperature in a range of from 600 to 800° C. down to 300° C., the material is cooled at an average cooling rate in a range of from 2 to 15° C./min, and preferably in a range of from 5 to 15° C./min, and thereby the average cooling rate increases and sufficient material strength is obtained. The average cooling rate below 300° C. is not limited, and it can be freely selected.

In the second heat treatment, since the cooling rate at high temperatures is low, the pro-eutectoid ferrite phase is also precipitated in the surface layer. When a suitable amount of the pro-eutectoid ferrite phase is precipitated in the surface layer, the rapid cooling at low temperatures is proceeded, and thereby sufficient material strength can be obtained.

In addition, in the second heat treatment, the temperature control is also carried out at the position of the material which corresponds to the top surface of the final product. Furthermore, the certain temperature in a range of from 800 to 600° C. and the cooling rate from the certain temperature to 300° C. are adjusted depending on the alloy composition, the size, the shape, and the like of the material.

Since the material is cooled to the certain temperature in a range of from 600 to 800° C. at a cooling rate which is lower than 2° C./min, that is, since the material is cooled at a relatively low cooling rate, a suitable amount of the pro-eutectoid ferrite phase is precipitated in the surface layer. After the material is cooled to a desired temperature, the cooling rate rapidly increases. If the temperature of the material is maintained similarly as in the first heat treatment, the precipitation of the pro-eutectoid ferrite phase is continuously proceeded, and sufficient material strength cannot be obtained. Therefore, in the second heat treatment, when the material is cooled to the desired temperature, the next cooling is immediately proceeded, for example, within 5 minutes. In the next cooling, since the material is cooled from the pro-eutectoid ferrite phase precipitation temperature range to low temperatures at a relatively high cooling rate, an excess precipitation of the pro-eutectoid ferrite phase does not occur. Therefore, the material is cooled from the certain temperature in a range of from 800 to 600° C. down to 300° C. at an average cooling rate in a range of from 2 to 15° C./min, and more preferably in a range form 5 to 15° C./min.

After these treatments, the low-alloy heat-resistant steel is further tempered so that 0.2% yield strength (strength at an early age) is in a range of from 588 to 647 MPa, and thereby the desired steel is prepared.

According to these heat treatment methods of the present invention, even when the material is large, the crystal grain size can be easily adjusted by adjusting the cooling rate.

In the low-alloy heat-resistant steels prepared by these heat treatment methods, a suitable amount of the pro-eutectoid ferrite phase is precipitated both in the center part and in the surface layer of the material. The crystal grain size of the average crystal grain of the bainite phase and the pro-eutectoid ferrite phase is in a range of from 3 to 6. That is, the crystal grain size of the low-alloy heat-resistant steel is suitable for avoiding creep embrittlement. In addition, in order to avoid creep embrittlement, the precipitation amount of the pro-eutectoid ferrite phase is preferably in a range of from 5 to 40% by volume. Furthermore, it is more preferable that carbonitride phases be finely dispersed in the pro-eutectoid ferrite phase.

In the low-alloy heat-resistant steel of the present invention, only small amounts of impurities are contained, the crystal grain size in the surface layer equals that in the center part, and the crystal grain size is effective for avoiding creep embrittlement. Therefore, the low-alloy heat-resistant steel of the present invention has excellent toughness, strength at high temperatures, and creep embrittlement resistance.

EXAMPLES

The present invention will be more specifically described with reference to the following examples and comparative examples.

First, the chemical compositions of the materials tested in the examples and the comparative examples are shown in the following Table 1. In Table 1, the materials Nos. 1 to 3, are reinforced by adding W to CrMoV steel. In addition, the materials Nos. 1 to 3 contain severely limited amounts of impurity elements, such as P, S, Cu, Al, As, Sn, and Sb, which are harmful, and thereby the quenching from a high temperature, such as 1,000° C. or greater, can be performed. The materials have high toughness and excellent high temperature properties, in particular, creep rupture resistance. The material No. 4 contains the alloy of the material No. 1 and Co. The matrix itself is thereby reinforced as well, and the toughness also increases. The material No. 4 has a good balance between toughness and strength. The materials Nos. 5 and 6 contain the alloy of the material No. 1 and at least one of Nb, Ta, N, and B. The quenching properties are thereby improved, and the creep rupture strength is also improved. In addition, adding these minor elements prevents the excess growth of the crystal grains during heating to high temperatures, and uniformly reduces the crystal grain size. Furthermore, these minor elements form carbonitrides, which are dispersed finely into the pro-eutectoid ferrite phase. Thereby, the pro-eutectoid ferrite phase is reinforced. The material No. 7 contains the alloy of the material No. 1 and at least one of Co, Nb, Ta, N, and B. The matrix itself is thereby reinforced as well, and the toughness also increases. Furthermore, the size of the crystal grains is easily reduced, and the crystal grains are dispersed uniformly.

Examples 1 to 3 and Comparative Examples 1 and 2

Below, the examples and the comparative examples are explained referring to Tables 1, 4 and 5.

Using the alloys having the compositions Nos. 1 to 3 in Table 1, the test pieces, which were heat treated under cooling conditions disclosed in Table 4, were prepared. The cooling simulates the cooling in the center part and in the surface layer of turbine rotors having a diameter of 1,200 mm.

In the examples 1 to 3, the test pieces were heated to 1,050° C., and then they were spray-quenched to 800° C. or 850° C. After that, the test pieces were left in the air for 0.5 hours or 1 hour and were thereby air cooled. Then, the test pieces were cooled to ordinary temperature by an oil-quenching or a spray-quenching.

In the comparative examples 1 and 2, the test pieces were oil quenched from 1,050° C., which is a conventional quenching temperature.

After that, these test pieces were tempered so that the strength at an early age (0.2% yield strength) is in a range of from 609 to 630 MPa.

The crystal grain size number and the precipitation amount of the pro-eutectoid ferrite phase of these test pieces were measured. The crystal grain size number was measured by the ferritic grain size determination for steels comprising mixed crystal grains, which is defined by JIS G 0552 (1998). The precipitation amount of the pro-eutectoid ferrite phase is measured using an ordinary image analysis device. These results are shown in Table 4.

In addition, the Charpy impact absorbed energy of these test pieces was measured. Furthermore, the creep rupture tests were carried out using these test pieces. In the creep rupture tests, the times elapsed before rupture were measured using unnotched test pieces and notched test pieces. These results are shown in Table 5.

It is clear from Tables 4 and 5 that the test pieces of the examples 1 to 3 contain the crystal grains of which the crystal grain size is in a range of from 3.6 to 4.2, that is, belongs to a range of from 3 to 6, and the precipitation amount of the pro-eutectoid ferrite phase of the test pieces is in a range of from 12 to 25%. In addition, it is also clear that the test pieces of the Examples 1 to 3 have characteristics superior to the desired ones for the materials, which are suitable for turbine rotors, that is, the Charpy impact absorbed energy at room temperature of 9.8 J or geater, the creep rupture time in the unnotched creep test at 600° C. and 147 MPa of 3,000 hours or greater, the creep rupture time in the notched creep test at 600° C. and 147 MPa of 10,000 hours or greater, the creep rupture time ratio of 1.6 or greater, and the unnotched creep rupture ratio of 50% or greater.

Figure 2:
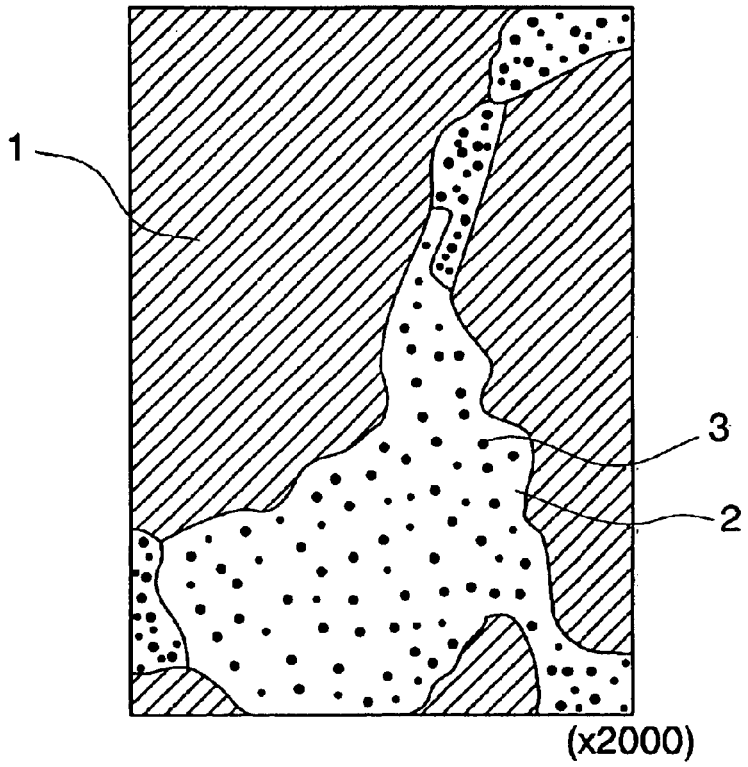
FIG. 2 is a diagram of the microphotograph showing the metallic structure of the test piece after the tempering.

FIG. 1 is a diagram taken from a microphotograph by a scanning electron microscope showing the structure of the test piece No. 1–8 before tempering. FIG. 2 is a diagram taken from a microphotograph showing the structure after tempering. As shown in FIGS. 1 and 2, the metallic structure of the test pieces contains a composite structure comprising the bainite phase 1 in which needle structures are gathered and the pro-eutectoid ferrite phase 2 comprising white flakes. In the metallic structure prior to tempering which is shown in FIG. 1, no structures can be observed inside the white pro-eutectoid ferrite phase 2. However, in the metallic structure after tempering, which is shown in FIG. 2, it is confirmed that black carbonitride phases 3 are finely dispersed in the white pro-eutectoid ferrite phase 2.

In contrast, in the test pieces of the comparative examples 1 and 2 which simulate the surface layer of turbine rotors, the pro-eutectoid ferrite phase is not precipitated, and the crystal grain sizes thereof are 2.3 or less, that is, the crystal grains are large. In addition, the Charpy impact absorbed energy is 23 J or less, which is larger than the desired value for turbine rotors but is smaller than that of the test pieces of the examples 1 to 3. The creep rupture ratio of the unnotched test piece is 28% or less, which indicates that the test piece is brittle. The time elapsed before creep rupture in the unnotched creep rupture test is in a range of from about 5,700 to 7,700, which is long, but the creep rupture time ratio is about 1.3, which indicates that creep embrittlement may occur in the test pieces.

Example 4 and Comparative Example 3

Below, an example and a comparative example are explained referring to Tables 1, 6, and 7.

Using the alloy which has the composition No. 4 in Table 1, that is, it contains Co, the test pieces, which were heat treated under cooling conditions disclosed in Table 6, were prepared.

In the example 4, the test pieces were heated to 1,050° C., spray-quenched to 750° C., and were left in the air for 0.5 hours; the test pieces were then spray-quenched to ordinary temperature.

In contrast, in the comparative example 3, the test piece was oil quenched from 1,050° C., which is a conventional quenching temperature.

After this, the test pieces were tempered so that the strength at an early age (0.2% yield strength) was in a range of from 618 to 626 MPa.

The crystal grain size number, the precipitation amount of the pro-eutectoid ferrite phase, and the Charpy impact absorbed energy of these test pieces were measured similarly as in the examples 1 to 3. In addition, the creep tests were also carried out. These results are shown in Tables 6 and 7.

It is clear from Tables 6 and 7 that the test pieces of the example 4 comprise crystal grains of which the crystal grain size number is 3.7 or 4.0 which is in a range of 3 to 6, and that they have a precipitation amount of the pro-eutectoid ferrite phase of 20% or 27%. The Charpy impact absorbed energy at room temperature is 46 J or greater, the time elapsed before creep rupture in the unnotched creep rupture test at 600° C. and 147 MPa is 8,000 hours or greater, the time elapsed before creep rupture in the notched creep rupture test at 600° C. and 147 MPa is more than 14,000 hours, the creep rupture time ratio is 1.70 or greater, and the unnotched creep rupture ratio is 76% or greater. These material characteristics are superior to the desired characteristics of the materials for turbine rotors.

In contrast, in the test piece of the comparative example 3, the pro-eutectoid ferrite phase is not precipitated, the crystal grain size number is 2.3, which indicates that the crystal grains are large, and the Charpy impact absorbed energy is 24 J, which is superior to the desired value for turbine rotors but is less than that of the test pieces in the example 4. In addition, in the test piece of the comparative example 3, the unnotched creep rupture ratio is 17.4%, which indicates that the test piece is brittle, the time elapsed before creep rupture in the unnotched creep rupture test is 9,000 hours or greater, which is long, but the time elapsed before creep rupture in the notched creep rupture test is only about 11,000 hours, and the creep rupture time ratio is 1.22, which indicates that creep embrittlement may occur in the test piece.

Examples 5 and 6, and Comparative Examples 4 and 5

Below, examples and comparative examples are explained referring to Tables 1, 8, and 9.

Using the alloys which have the composition Nos. 5 and 6 in Table 1, that is, those that contain minor impurity elements, the test pieces, which were heat treated under cooling conditions as specified in Table 8, were prepared.

In the examples 5 and 6, the test pieces were heated to 1,050° C., were spray-quenched to 800° C. or 850° C., and were left in the air for 1 hour or for 2 hours and were thereby air cooled; and the test pieces were then spray-quenched or oil quenched to ordinary temperature.

In contrast, in the comparative examples 4 and 5, the test pieces were oil quenched from 1,050° C., which is a conventional quenching temperature.

After that, the test pieces were tempered so that the strength at an early age (0.2% yield strength) is in a range of from 610 to 627 MPa.

The crystal grain size number, the precipitation amount of the pro-eutectoid ferrite phase, and the Charpy impact absorbed energy of these test pieces were measured similarly in the examples 1 to 3. In addition, the creep tests were also carried out. These results are shown in Tables 8 and 9.

It is clear from Tables 8 and 9 that the test pieces of the examples 5 and 6 comprise crystal grains of which the crystal grain size number is in a range of from 3.8 to 4.3, that is, the crystal grain size number within a range of 3 to 6, and they have the precipitation amount of the pro-eutectoid ferrite phase in a range of from 16% to 26%. The Charpy impact absorbed energy at room temperature is 33 J or greater, the time elapsed before creep rupture in the unnotched creep rupture test at 600° C. and 147 MPa is 8,300 hours or greater, the time elapsed before creep rupture in the notched creep rupture test at 600° C. and 147 MPa is more than 14,000 hours, the creep rupture time ratio is 1.6 or greater, and the unnotched creep rupture ratio is 78% or greater. These material characteristics are superior to the desired characteristics of the materials for turbine rotors.

In contrast, in the test pieces of the comparative examples 4 and 5, the pro-eutectoid ferrite phase is not precipitated, the crystal grain size number is 2.4 or 2.6, which indicates that the crystal grains are large, the Charpy impact absorbed energy at room temperature is 20 J or less, which is superior to the desired value for turbine rotors, but is less than that of the test pieces in the examples 5 and 6. In addition, in the test pieces of the comparative examples 4 and 5, the unnotched creep rupture ratio is 11.9% or 23.1%, which indicates that the test pieces are brittle, the time elapsed before creep rupture in the unnotched creep rupture test is about 9,300 hours or greater, which is long, but the time elapsed before creep rupture in the notched creep rupture test is about only 9,600 hours or about 11,300 hours, and the creep rupture time ratio is 1.03 or 1.13, which indicates that creep embrittlement may occur in the test pieces.

Examples 7 and Comparative Example 6

Below, an example and a comparative example are explained referring to Tables 1, 10 and 11.

Using the alloy which has the composition No. 7 in Table 1, that is, it contains Co and minor impurity elements, test pieces, which were heat treated under cooling conditions specified in Table 10, were prepared.

In the example 7, the test pieces were heated to 1,050° C., spray-quenched to 800° C., were left in the air for 1.0 hour and were thereby air cooled, and were then spray-quenched to ordinary temperature.

In contrast, in the comparative example 6, the test piece was oil quenched from 1,050° C. which is a conventional quenching temperature.

After that, the test pieces were tempered so that the strength at an early age (0.2% yield strength) is in a range of from 605 to 634 MPa.

The crystal grain size number, the precipitation amount of the pro-eutectoid ferrite phase, and the Charpy impact absorbed energy of these test pieces were measured similarly as in the examples 1 to 3. In addition, the creep tests were also carried out. These results are shown in Tables 10 and 11.

It is clear from Tables 10 and 11 that the test pieces of the example 7 comprise crystal grains of which the crystal grain size number is 3.9 or 4.3 which is in a range of 3 to 6, and they have the precipitation amount of the pro-eutectoid ferrite phase of 24% or 32%. The Charpy impact absorbed energy at room temperature is 37 J or greater, the time elapsed before creep rupture in the unnotched creep rupture test at 600° C. and 147 MPa is 8,400 hours or greater, the time elapsed before creep rupture in the notched creep rupture test at 600° C. and 147 MPa is more than 14,000 hours, the creep rupture time ratio is 1.64 or greater, and the unnotched creep rupture ratio is 74% or greater. These material characteristics are superior to the desired characteristics of the materials for turbine rotors.

In contrast, in the test piece of the comparative example 6, which simulates the surface layer of the turbine rotors, the pro-eutectoid ferrite phase is not precipitated, the crystal grain size number is 2.5, which indicates that the crystal grains are large, the Charpy impact absorbed energy at room temperature is 21 J, which is superior to the desired value for turbine rotors but is smaller than that of the test pieces in the example 7. In addition, in the test piece of the comparative example 6, the unnotched creep rupture ratio is 25.6%, which indicates that the test piece is brittle, the time elapsed before creep rupture in the unnotched creep rupture test is about 9,500 hours, which is long, but the time elapsed before creep rupture in the notched creep rupture test is only about 11,800 hours, and the creep rupture time ratio is 1.24, which indicates that creep embrittlement may occur in the test piece.

Examples 8 to 11

Below, the examples are explained referring to Tables 1, 12 and 13.

Using the alloys which have the compositions Nos. 1, 4, 5, and 7 in Table 1, the test pieces, which were heat treated under cooling conditions disclosed in Table 12, were prepared.

In the examples 8 to 11, the test pieces were heated to 1,050° C., cooled to 650° C. or 700° C. at 1.4° C./min or 1.8° C./min, were cooled from 650° C. or 700° C to 300° C. at 6.5° C./min or 5.1° C./min, and were then cooled to ordinary temperature. After that, the test pieces were tempered so that the strength at an early age (0.2% yield strength) was in a range of from 615 to 627 MPa.

The crystal grain size number, the precipitation amount of the pro-eutectoid ferrite phase, and the Charpy impact absorbed energy of these test pieces were measured similarly as in the examples 1 to 3. In addition, the creep tests were also carried out. These results are shown in Tables 12 and 13.

It is clear from Tables 12 and 13 that the test pieces of the examples 8 to 11 comprise crystal grains of which the crystal grain size number is in a range of from 3.5 to 4.2 which are in a range of 3 to 6, and they have a precipitation amount of the pro-eutectoid ferrite phase in a range of from 13% to 29%. The Charpy impact absorbed energy at room temperature is 32 J or greater, the time elapsed before creep rupture in the unnotched creep rupture test at 600° C. and 147 MPa is 6,700 hours or greater, the time elapsed before creep rupture in the notched creep rupture test at 600° C. and 147 MPa is more than 14,000 hours, the creep rupture time ratio is 1.63 or greater, and the unnotched creep rupture ratio is 74% or greater. These material characteristics are superior to the desired characteristics of the materials for turbine rotors.

TABLE 1

| Sample | Chemical Composition (wt %) | | | | | | | | | | |
|---|---|---|---|---|---|---|---|---|---|---|---|
| No. | C | Si | Mn | Ni | Cr | Mo | W | V | Nb | Ta | Co |
| 1 | 0.26 | 0.05 | 0.09 | 0.08 | 1.46 | 0.54 | 2.40 | 0.25 | | | |
| 2 | 0.27 | 0.29 | 0.18 | 0.19 | 1.23 | 1.02 | 1.52 | 0.21 | | | |
| 3 | 0.31 | 0.03 | 0.23 | 0.09 | 1.04 | 0.52 | 2.42 | 0.24 | | | |
| 4 | 0.27 | 0.08 | 0.20 | 0.09 | 1.35 | 1.20 | 2.38 | 0.24 | | | 1.48 |
| 5 | 0.27 | 0.08 | 0.20 | 0.08 | 1.35 | 1.22 | 2.39 | 0.23 | 0.06 | 0.05 | |
| 6 | 0.26 | 0.07 | 0.19 | 0.10 | 1.34 | 1.20 | 2.40 | 0.24 | 0.07 | | |
| 7 | 0.27 | 0.07 | 0.20 | 0.08 | 1.33 | 1.20 | 2.42 | 0.24 | 0.08 | | 0.98 |

| Sample | Chemical Composition (wt %) | | | | | | | | | |
|---|---|---|---|---|---|---|---|---|---|---|
| No. | N | B | P | S | Cu | Al | As | Sn | Sb | Fe |
| 1 | | | 0.006 | 0.001 | 0.03 | 0.003 | 0.006 | 0.005 | 0.0012 | balance |
| 2 | | | 0.010 | 0.002 | 0.02 | 0.005 | 0.004 | 0.006 | 0.0013 | balance |
| 3 | | | 0.006 | 0.001 | 0.01 | 0.003 | 0.006 | 0.005 | 0.0015 | balance |
| 4 | | | 0.006 | 0.001 | 0.01 | 0.002 | 0.006 | 0.005 | 0.0013 | balance |
| 5 | | 0.006 | 0.005 | 0.001 | 0.01 | 0.002 | 0.006 | 0.007 | 0.0014 | balance |
| 6 | 0.008 | | 0.007 | 0.001 | 0.02 | 0.002 | 0.007 | 0.006 | 0.0013 | balance |
| 7 | 0.006 | | 0.005 | 0.002 | 0.02 | 0.004 | 0.007 | 0.005 | 0.0011 | balance |

TABLE 2

| | Sample No. | Material No. | Simulated position | Austenitic grain size number | Precipitation amount of pro-eutectoid ferrite phase (Vol %) |
|---|---|---|---|---|---|
| Example | 1-1 | 1 | Center part | 4.1 | 0 |
| | 1-2 | 1 | Surface layer | 4.1 | 0 |
| | 1-3 | 1 | Center part | 3.2 | 0 |
| | 1-4 | 1 | Surface layer | 3.2 | 0 |
| Comparative Example | 1-5 | 1 | Center part | 2.3 | 0 |
| | 1-6 | 1 | Surface layer | 2.5 | 0 |

TABLE 3

| | | Material characteristic | | | | | | |
|---|---|---|---|---|---|---|---|---|
| | | | | Creep rupture test at 600° C. and 147 MPa | | | | |
| | Sample No. | 0.2% Yield (MPa) | Charpy impact absorbed energy (J) | Unnotched creep rupture time (h) A | Unnotched creep rupture ratio (%) | Notched creep rupture time (h) B | Creep rupture time ratio B/A | Note |
| Example | 1-1 | 623 | 61 | 6,995 | 82.8 | more than 14,000 | 2.00 or greater | |
| | 1-2 | 620 | 59 | 6,751 | 83.9 | more than 14,000 | 2.07 or greater | |
| | 1-3 | 625 | 41 | 7,103 | 72.1 | more than 14,000 | 1.97 or greater | |
| | 1-4 | 623 | 43 | 7,026 | 74.6 | more than 14,000 | 1.99 or greater | |
| Comparative Example | 1-5 | 630 | 30 | 7,664 | 28.4 | 10,205 | 1.33 | Unnotched creep rupture ratio is too small, and Creep rupture time ratio is insufficient. |
| | 1-6 | 628 | 28 | 7,581 | 30.3 | 10,543 | 1.39 | Unnotched creep rupture ratio is too small, and Creep rupture time ratio is insufficient. |

TABLE 4

| | Sample No. | Material No. | Cooling conditions | Simulated part | Crystal grain size number | Precipitation amount of pro-eutectoid ferrite phase (Vol %) |
|---|---|---|---|---|---|---|
| Example 1 | 1-7 | 1 | Spray quenching from 1,050° C. to 850° C., air cooling for 1 hour, and then oil quenching | Center part | 3.8 | 22 |
| | 1-8 | 1 | Spray quenching from 1,050° C. to 850° C., air cooling for 1 hour, and then oil quenching | Surface layer | 4.2 | 23 |
| Example 2 | 2-1 | 2 | Spray quenching from 1,050° C. to 850° C., air cooling for 1 hour, and then spray-quenching | Center part | 3.6 | 12 |
| | 2-2 | 2 | Spray quenching from 1,050° C. to 850° C., air cooling for 1 hour, and then spray-quenching | Surface layer | 4.0 | 16 |
| Comparative Example 1 | 2-3 | 2 | Oil quenching from 1,050° C. | Surface layer | 2.3 | 0 |
| Example 3 | 3-1 | 3 | Spray quenching from 1,050° C. to 850° C., air cooling for 0.5 hours, and then spray-quenching | Center part | 3.7 | 16 |
| | 3-2 | 3 | Spray quenching from 1,050° C. to 850° C., air cooling for 0.5 hours, and then spray-quenching | Surface layer | 4.0 | 25 |
| Comparative Example 2 | 3-3 | 3 | Oil quenching from 1,050° C. | Surface layer | 2.2 | 0 |

TABLE 5

| | | Material characteristic | | | | | | |
|---|---|---|---|---|---|---|---|---|
| | | | | Creep rupture test at 600° C. and 147 MPa | | | | |
| | Sample No. | 0.2% Yield (MPa) | Charpy impact absorbed energy (J) | Unnotched creep rupture time (h) A | Unnotched creep rupture ratio (%) | Notched creep rupture time (h) B | Creep rupture time ratio B/A | Note |
| Example 1 | 1-7 | 609 | 55 | 6,570 | 79.9 | more than 14,000 | 2.13 or greater | |
| | 1-8 | 614 | 51 | 6,470 | 81.2 | more than 14,000 | 2.19 or greater | |
| Example 2 | 2-1 | 611 | 53 | 5,359 | 75.0 | more than 14,000 | 2.61 or greater | |
| | 2-2 | 613 | 58 | 5,271 | 80.4 | more than 14,000 | 2.66 or greater | |
| Comparative Example 1 | 2-3 | 609 | 23 | 5,733 | 28.0 | 7,521 | 1.31 | Unnotched creep rupture ratio is too small, and Creep rupture time ratio is insufficient. |
| Example 3 | 3-1 | 628 | 38 | 7,252 | 77.3 | more than 14,000 | 1.93 or greater | |
| | 3-2 | 626 | 37 | 7,026 | 81.0 | more than 14,000 | 1.99 or greater | |
| Comparative Example 2 | 3-3 | 630 | 16 | 7,721 | 19.2 | 9,881 | 1.28 | Unnotched creep rupture ratio is too small, and Creep rupture time ratio is insufficient. |

TABLE 6

| | Sample No. | Material No. | Cooling conditions | Simulated part | Crystal grain size number | Precipitation amount of pro-eutectoid ferrite phase (Vol %) |
|---|---|---|---|---|---|---|
| Example 4 | 4-1 | 4 | Spray quenching from 1,050° C. to 850° C., air cooling for 0.5 hours, and then spray-quenching | Center part | 3.7 | 27 |
| | 4-2 | 4 | Spray quenching from 1,050° C. to 850° C., air cooling for 0.5 hours, and then spray-quenching | Surface layer | 4.0 | 20 |
| Comparative Example 3 | 4-3 | 4 | Oil quenching from 1,050° C. | Surface layer | 2.3 | 0 |

TABLE 7

| | | Material characteristic | | | | | | |
|---|---|---|---|---|---|---|---|---|
| | | | | Creep rupture test at 600° C. and 147 MPa | | | | |
| | Sample No. | 0.2% Yield (MPa) | Charpy impact absorbed energy (J) | Unnotched creep rupture time (h) A | Unnotched creep rupture ratio (%) | Notched creep rupture time (h) B | Creep rupture time ratio B/A | Note |
| Example 4 | 4-1 | 618 | 46 | 8,071 | 76.5 | more than 14,000 | 1.73 or greater | |
| | 4-2 | 625 | 59 | 8,237 | 79.4 | more than 14,000 | 1.70 or greater | |
| Comparative Example 3 | 4-3 | 626 | 24 | 9,032 | 17.4 | 11,056 | 1.22 | Unnotched creep rupture ratio is too small, and Creep rupture time ratio is insufficient. |

TABLE 8

| | Sample No. | Material No. | Cooling conditions | Simulated part | Crystal grain size number | Precipitation amount of pro-eutectoid ferrite phase (Vol %) |
|---|---|---|---|---|---|---|
| Example 5 | 5-1 | 5 | Spray quenching from 1,050° C. to 850° C., air cooling for 1 hour, and then oil quenching | Center part | 4.0 | 16 |
| | 5-2 | 5 | Spray quenching from 1,050° C. to 850° C., air cooling for 1 hour, and then oil quenching | Surface layer | 4.3 | 26 |
| Comparative Example 4 | 5-3 | 5 | Oil quenching from 1,050° C. | Surface layer | 2.6 | 0 |
| Example 6 | 6-1 | 6 | Spray quenching from 1,050° C. to 850° C., air cooling for 0.5 hours, and then spray-quenching | Center part | 3.8 | 26 |
| | 6-2 | 6 | Spray quenching from 1,050° C. to 850° C., air cooling for 0.5 hours, and then spray-quenching | Surface layer | 4.2 | 19 |
| Comparative Example 5 | 6-3 | 6 | Oil quenching from 1,050° C. | Surface layer | 2.4 | 0 |

TABLE 9

| | | Material characteristic | | | | | | |
|---|---|---|---|---|---|---|---|---|
| | | | | Creep rupture test at 600° C. and 147 MPa | | | | |
| | Sample No. | 0.2% Yield (MPa) | Charpy impact absorbed energy (J) | Unnotched creep rupture time (h) A | Unnotched creep rupture ratio (%) | Notched creep rupture time (h) B | Creep rupture time ratio B/A | Note |
| Example 5 | 5-1 | 615 | 37 | 8,650 | 80.1 | more than 14,000 | 1.62 or greater | |
| | 5-2 | 610 | 42 | 8,371 | 81.6 | more than 14,000 | 1.67 or greater | |
| Comparative Example 4 | 5-3 | 623 | 16 | 9,313 | 11.9 | 9,612 | 1.03 | Unnotched creep rupture ratio is too small, and Creep rupture time ratio is insufficient. |
| Example 6 | 6-1 | 627 | 33 | 8,467 | 78.2 | more than 14,000 | 1.65 or greater | |
| | 6-2 | 620 | 35 | 8,694 | 78.5 | more than 14,000 | 1.61 or greater | |
| Comparative Example 5 | 6-3 | 616 | 20 | 9,605 | 23.1 | 11,323 | 1.13 | Unnotched creep rupture ratio is too small, and Creep rupture time ratio is insufficient. |

TABLE 10

| | Sample No. | Material No. | Cooling conditions | Simulated part | Crystal grain size number | Precipitation amount of pro-eutectoid ferrite phase (Vol %) |
|---|---|---|---|---|---|---|
| Example 7 | 7-1 | 7 | Spray quenching from 1,050° C. to 800° C., air cooling for 1 hour, and then spray-quenching | Center part | 3.9 | 24 |
| | 7-2 | 7 | Spray quenching from 1,050° C. to 800° C., air cooling for 1 hour, and then oil quenching | Surface layer | 4.3 | 32 |
| Comparative Example 6 | 7-3 | 7 | Oil quenching from 1,050° C. | Surface layer | 2.5 | 0 |

TABLE 11

| | | Material characteristic | | | | | | |
|---|---|---|---|---|---|---|---|---|
| | | | | Creep rupture test at 600° C. and 147 MPa | | | | |
| | Sample No. | 0.2% Yield (MPa) | Charpy impact absorbed energy (J) | Unnotched creep rupture time (h) A | Unnotched creep rupture ratio (%) | Notched creep rupture time (h) B | Creep rupture time ratio B/A | Note |
| Example 7 | 7-1 | 610 | 40 | 8,511 | 74.6 | more than 14,000 | 1.64 or greater | |
| | 7-2 | 605 | 37 | 8,403 | 78.1 | more than 14,000 | 1.67 or greater | |
| Comparative Example 6 | 7-3 | 634 | 21 | 9,520 | 25.6 | 11,836 | 1.24 | Unnotched creep rupture ratio is too small, and Creep rupture time ratio is insufficient. |

TABLE 12

| | Sample No. | Material No. | Cooling Conditions | Simulated part | Crystal grain size number | Precipitation amount of pro-eutectoid ferrite phase (Vol %) |
|---|---|---|---|---|---|---|
| Example 8 | 1-9 | 1 | 1,050° C. to 650° C.: 1.4° C./min<br>650° C. to 300° C.: 6.5° C./min | Center part | 3.5 | 16 |
| | 1-10 | 1 | 1,050° C. to 650° C.: 1.4° C./min<br>650° C. to 300° C.: 6.5° C./min | Surface layer | 3.7 | 17 |
| Example 9 | 4-4 | 4 | 1,050° C. to 650° C.: 1.4° C./min<br>650° C. to 300° C.: 6.5° C./min | Center part | 3.6 | 21 |
| | 4-5 | 4 | 1,050° C. to 650° C.: 1.4° C./min<br>650° C. to 300° C.: 6.5° C./min | Surface layer | 3.8 | 18 |
| Example 10 | 5-4 | 5 | 1,050° C. to 700° C.: 1.8° C./min<br>700° C. to 300° C.: 6.5° C./min | Center part | 3.5 | 14 |
| | 5-3 | 5 | 1,050° C. to 700° C.: 1.8° C./min<br>700° C. to 300° C.: 6.5° C./min | Surface layer | 3.5 | 13 |
| Example 11 | 7-4 | 7 | 1,050° C. to 650° C.: 1.4° C./min<br>650° C. to 300° C.: 5.1° C./min | Center part | 3.8 | 26 |
| | 7-5 | 7 | 1,050° C. to 650° C.: 1.4° C./min<br>650° C. to 300° C.: 5.1° C./min | Surface layer | 4.2 | 29 |

TABLE 13

| | | Material characteristic | | | | | | |
|---|---|---|---|---|---|---|---|---|
| | | | | Creep rupture test at 600° C. and 147 MPa | | | | |
| | Sample No. | 0.2% Yield (MPa) | Charpy impact absorbed energy (J) | Unnotched creep rupture time (h) A | Unnotched creep rupture ratio (%) | Notched creep rupture time (h) B | Creep rupture time ratio B/A | Note |
| Example 8 | 1-9 | 623 | 36 | 7,036 | 78.3 | more than 14,000 | 1.99 or greater | |
| | 1-10 | 620 | 44 | 6,755 | 79.0 | more than 14,000 | 2.07 or greater | |
| Example 9 | 4-4 | 623 | 43 | 8,230 | 74.9 | more than 14,000 | 1.70 or greater | |
| | 4--5 | 618 | 50 | 7,963 | 77.0 | more than 14,000 | 1.76 or greater | |
| Example 10 | 5-4 | 626 | 32 | 8,458 | 78.6 | more than 14,000 | 1.66 or greater | |
| | 5-5 | 627 | 35 | 8,203 | 78.0 | more than 14,000 | 1.71 or greater | |
| Example 11 | 7-4 | 615 | 34 | 8,607 | 74.6 | more than 14,000 | 1.63 or greater | |
| | 7-5 | 618 | 41 | 8,395 | 78.0 | more than 14,000 | 1.67 or greater | |

What is claimed is:

1. A low-alloy heat-resistant steel comprising:

carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, antimony in an amount not greater than 0.003% by weight, and the balance being iron and unavoidable impurities, and containing a metallic structure having a grain size number in a range of from 3 to 6.

2. A low-alloy heat-resistant steel comprising:

carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, cobalt in an amount of 0.1 to 3.5% by weight, phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, antimony in an amount not greater than 0.003% by weight, and the balance being iron and unavoidable impurities, and containing a metallic structure having a grain size number in a range of from 3 to 6.

3. A low-alloy heat-resistant steel comprising:

carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, at least one of niobium in an amount of 0.01 to 0.15% by weight, tantalum in an amount of 0.01 to 0.15% by weight, nitrogen in an amount of 0.001 to 0.05% by weight, and boron in an amount of 0.001 to 0.015% by weight, phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, antimony in an amount not greater than 0.003% by weight, and the balance being iron and unavoidable impurities, and containing a metallic structure having a grain size number in a range of from 3 to 6.

4. A low-alloy heat-resistant steel comprising:

carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, cobalt in an amount of 0.1 to 3.5% by weight, at least one of niobium in an amount of 0.01 to 0.15% by weight, tantalum in an amount of 0.01 to 0.15% by weight, nitrogen in an amount of 0.001 to 0.05% by weight, and boron in an amount of 0.001 to 0.015% by weight, phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, antimony in an amount not greater than 0.003% by weight, and the balance being iron and unavoidable impurities, and containing a metallic structure having a grain size number in a range of from 3 to 6.

5. A low-alloy heat-resistant steel according to claim 1, wherein said metallic structure mainly contains a bainite phase and a pro-eutectoid ferrite phase.

6. A low-alloy heat-resistant steel according to claim 2, wherein said metallic structure mainly contains a bainite phase and a pro-eutectoid ferrite phase.

7. A law-alloy heat-resistant steel according to claim 3, wherein said metallic structure mainly contains a bainite phase and a pro-eutectoid ferrite phase.

8. A low-alloy heat-resistant steel according to claim 4, wherein said metallic structure mainly contains a bainite phase and a pro-eutectoid ferrite phase.

9. A low-alloy heat-resistant steel according to claim 1, wherein said metallic structure contains a pro-eutectoid ferrite phase in a range of from 5 to 40% by volume.

10. A low-alloy heat-resistant steel according to claim 2, wherein said metallic structure contains a pro-eutectoid ferrite phase in a range of from 5 to 40% by volume.

11. A low-alloy heat-resistant steel according to claim 3, wherein said metallic structure contains a pro-eutectoid ferrite phase in a range of from 5 to 40% by volume.

12. A low-alloy heat-resistant steel according to claim 4, wherein said metallic structure contains a pro-eutectoid ferrite phase in a range of from 5 to 40% by volume.

13. A low-alloy heat-resistant steel according to claim 1, wherein said metallic structure contains a pro-eutectoid ferrite phase, and carbonitrides are finely dispersed into said pro-eutectoid ferrite phase.

14. A low-alloy heat-resistant steel according to claim 2, wherein said metallic structure contains a pro-eutectoid ferrite phase, and carbonitrides are finely dispersed into said pro-eutectoid ferrite phase.

15. A low-alloy heat-resistant steel according to claim 3, wherein said metallic structure contains a pro-eutectoid ferrite phase, and carbonitrides are finely dispersed into said pro-eutectoid ferrite phase.

16. A low-alloy heat-resistant steel according to claim 4, wherein said metallic structure contains a pro-eutectoid ferrite phase, and carbonitrides are finely dispersed into said pro-eutectoid ferrite phase.

17. A method of making a low-alloy heat-resistant steel, the method comprising:

heating a steel ingot to a range of from 1,000 to 1,100° C., which comprises carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, and the balance being iron and unavoidable impurities;

cooling said steel ingot to a certain temperature in a range of from 900 to 700° C. by a spray-quenching and/or an air-blast quenching, air cooling for from 5 minutes to 5 hours, cooling again by at least one method of a spray-quenching, an air-blast quenching, and an oil quenching, and producing the steel of claim 1.

18. A method of making a low-alloy heat-resistant steel, the method comprising:

heating a steel ingot to a range of from 1,000 to 1,100° C., which comprises carbon in an amount of 0.20 to 0.35% by weight, silicon in an amount of 0.005 to 0.35% by weight, manganese in an amount of 0.05 to 1.0% by weight, nickel in an amount of 0.05 to 0.3% by weight, chromium in an amount of 0.8 to 2.5% by weight, molybdenum in an amount of 0.1 to 1.5% by weight, tungsten in an amount of 0.1 to 2.5% by weight, vanadium in an amount of 0.05 to 0.3% by weight, and the balance being iron and unavoidable impurities;

cooling said steel ingot to a temperature in a range of from 800 to 600° C. at an average cooling rate of 2° C./mn or less;

cooling to 300° C. at an average cooling rate in a range of from 2 to 15° C./min; and producing the steel of claim 1.

19. A method according to claim 17, wherein said steel ingot further comprises at least one of niobium in an amount of 0.01 to 0.15% by weight, tantalum in an amount of 0.01 to 0.15% by weight, cobalt in an amount of 0.1 to 3.5% by weight, nitrogen in an amount of 0.001 to 0.05% by weight, and boron in an amount of 0.001 to 0.015% by weight.

20. A method according to claim 18, wherein said steel ingot further comprises at least one of niobium in an amount of 0.01 to 0.15% by weight, tantalum in an amount of 0.01 to 0.15% by weight, cobalt in an amount of 0.1 to 3.5% by weight, nitrogen in an amount of 0.001 to 0.05% by weight, and boron in an amount of 0.001 to 0.015% by weight.

21. A method according to claim 17, wherein said unavoidable impurities contain phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, and antimony in an amount not greater than 0.003% by weight.

22. A method according to claim 18, wherein said unavoidable impurities contain phosphorus in an amount not greater than 0.012% by weight, sulfur in an amount not greater than 0.005% by weight, copper in an amount not greater than 0.10% by weight, aluminum in an amount not greater than 0.01% by weight, arsenic in an amount not greater than 0.01% by weight, tin in an amount not greater than 0.01% by weight, and antimony in an amount not greater than 0.003% by weight.

23. A turbine rotor comprising the low-alloy heat-resistant steel of claim 1.

24. A turbine rotor comprising the low-alloy heat-resistant steel of claim 2.

25. A turbine rotor comprising the low-alloy heat-resistant steel of claim 3.

26. A turbine rotor comprising the low-alloy heat-resistant steel of claim 4.

* * * * *